United States Patent [19]

Dean et al.

[11] 4,125,281

[45] Nov. 14, 1978

[54] DOOR LOCK ASSEMBLY

[75] Inventors: John H. Dean; Albert Dean, Jr., both of San Antonio, Tex.

[73] Assignee: Deansteel Manufacturing Company, San Antonio, Tex.

[21] Appl. No.: 823,090

[22] Filed: Aug. 9, 1977

[51] Int. Cl.[2] ..... E05C 1/04

[52] U.S. Cl. ..... 292/148; 70/129

[58] Field of Search ..... 292/42, 104, 145, 148, 292/150, 151, 153, 189; 70/54, 55, 56, 129

[56] References Cited

U.S. PATENT DOCUMENTS

| | | | |
|---|---|---|---|
| 145,131 | 12/1873 | Smith | 292/148 |
| 1,041,700 | 10/1912 | Thornley | 292/148 X |
| 1,260,469 | 3/1918 | Smith | 292/148 X |
| 1,724,116 | 8/1929 | Swearengin | 292/145 X |
| 2,781,215 | 2/1957 | Griffith | 292/148 |
| 3,334,933 | 8/1967 | Ehlers | 292/148 |
| 3,374,020 | 3/1968 | Berg | 292/148 X |
| 3,799,593 | 3/1974 | Dielman | 292/145 |
| 3,815,945 | 6/1974 | Lamphere | 292/340 |
| 3,838,586 | 10/1974 | Tennison | 70/56 |

FOREIGN PATENT DOCUMENTS

| | | | |
|---|---|---|---|
| 509,856 | 3/1952 | Belgium | 292/148 |
| 103,308 | 2/1964 | Norway | 70/56 |
| 235,461 | 6/1925 | United Kingdom | 292/145 |

*Primary Examiner*—Thomas J. Holko

*Attorney, Agent, or Firm*—Emory L. Groff, Jr.

[57] ABSTRACT

A door assembly includes a door panel having a reciprocating bolt mounted therebehind with its nose projectable through the door side edge and into a keeper opening in an adjacent door frame side edge. Extending normal to the base of the bolt is an actuator having a lock section disposed through a cutout in the door panel. A lock plate extends outwardly from the door adjacent the panel cutout and includes an offset handle plate overlying the actuator when the bolt is moved to its locked position, at which time a security plate attached to the actuator behind the panel closes or masks the cutout. Aligned openings in the lock section and lock plate then allow the application of a suitable lock device to immobilize the lock section and bolt in the locked position.

5 Claims, 7 Drawing Figures

FIG. 1.
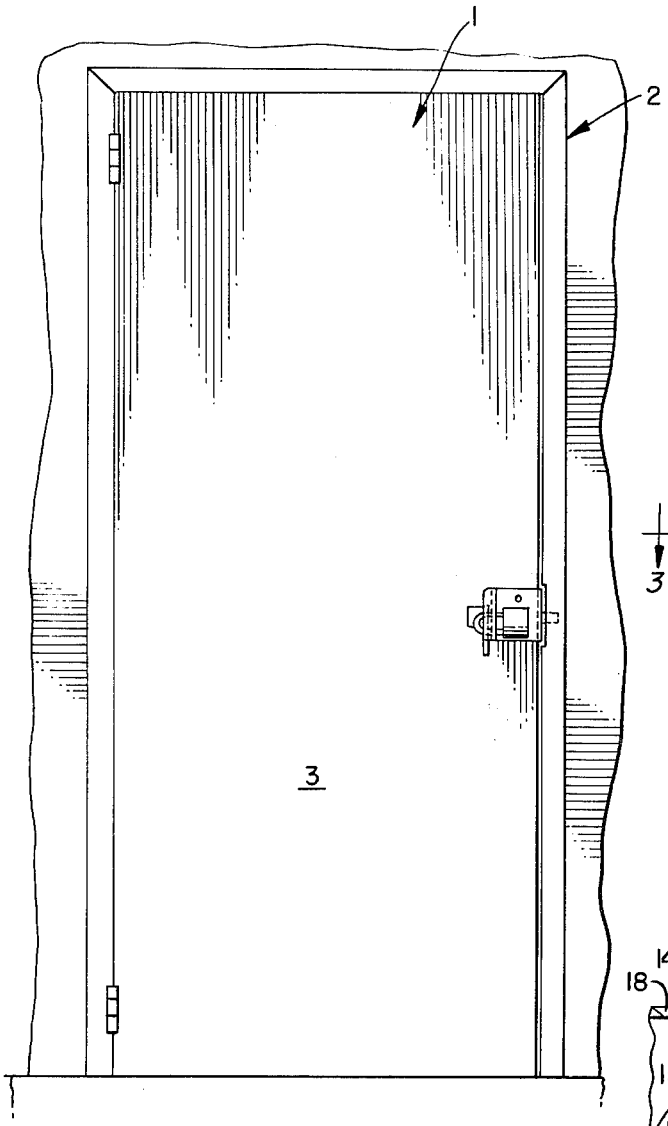
FIG. 2.
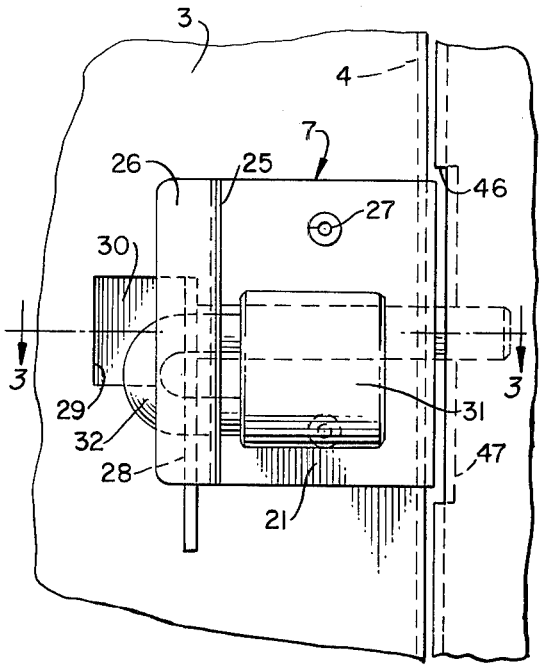
FIG. 3.
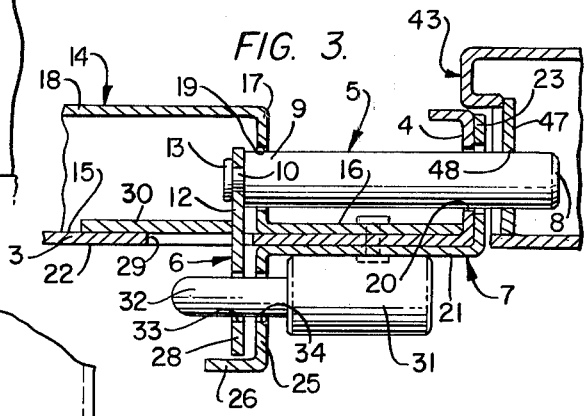
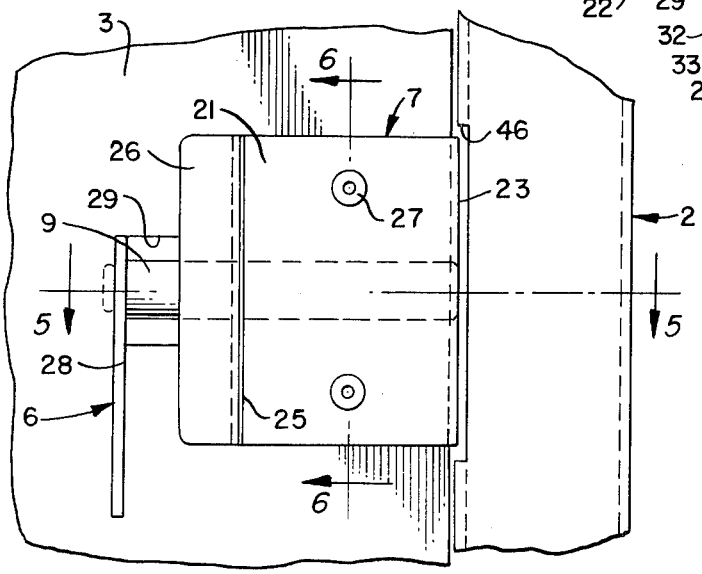
FIG. 4.

DOOR LOCK ASSEMBLY

This invention relates generally to closure devices, and more particularly, to an improved door lock assembly for doors especially constructed of metal.

The present invention offers an extremely simple and economical solution to the problem of providing an uncomplicated yet positive lock assembly for a sheet metal door and frame structure wherein security against forced entry is most definitely required. The instant assembly was born out of a need for providing a secure lock arrangement for use with metal door structures as employed with public storage lockers involving a large building subdivided into a plurality of cubicles each having a sole access intended to be enclosed by a single large metal door. In view of the past history of numerous instances of forced entry through prior known lock assemblies, it became necessary to devise a suitable construction which could be readily mass produced at a minimum cost and which would ensure the utmost security against forced entry.

By means of the present structure, an arrangement is provided wherein a single movable bolt/actuator sub-assembly is uniquely mounted behind the outer panel of a metal door and cooperates with a stationary handle member, the latter of which provides not only a handle for opening the door but also serves as a guard or shield overlying the major portion of the actuator when the bolt is in the locked position, which arrangement partially masks the shackle of an appropriate lock device such as a padlock, to further discourage the unwarranted use or a hacksaw or bolt cutters upon the applied padlock.

Accordingly, one of the objects of the present invention is to provide an improved door lock assembly for a metal door and frame including a reciprocating bolt mounted behind the panel of the door and including an actuator extending through an opening in the door panel, which actuator when shifted to a bolt locking position is at least partially shielded by a fixed door handle plate.

A further object of the present invention is to provide an improved door lock assembly for a metal door including a fixed handle member attached to the outer panel of the door and provided with a normal edge plate having an opening receiving a sliding bolt and wherein the handle member includes an offset plate cooperating with an extension projecting from the bolt through a door panel opening which is adapted to be mechanically secured to the handle member when the bolt is in the locked position.

Still another object of the present invention is to provide an improved metal door lock assembly including a reciprocating bolt behind the outer panel of the door with an opening in the door panel, which actuator includes a stabilizing plate juxtaposed the interior surface of the door panel and movable with the sliding bolt to mask the door panel cutout when the bolt and actuator are in the locked position.

With these and other objects in view which will more readily appear as the nature of the invention is understood, the invention consists of the novel construction, combination and arrangement of parts hereinafter more fully described, illustrated and claimed.

A preferred and practical embodiment of the invention is shown in the accompanying drawings in which:

FIG. 1 is a front view of the door lock assembly of the present invention.

FIG. 2 is a fragmentary enlarged view of the lock assembly shown in FIG. 1.

FIG. 3 is a horizontal sectional view taken along the line 3—3 of FIG. 2.

FIG. 4 is a view similar to FIG. 2, but illustrates the bolt and its actuator as they appear when in the open or unlocked position.

Similar reference characters designate corresponding parts throughout the several figures of the drawings.

Figure 5:
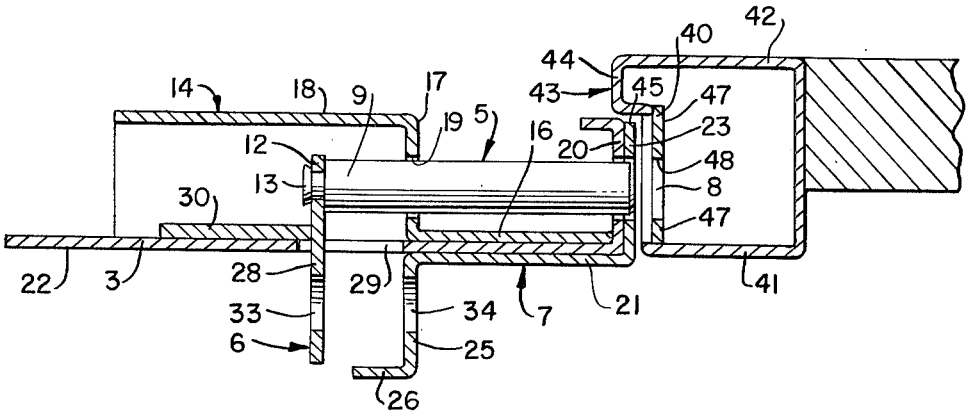
FIG. 5 is a transverse sectional view taken along the line 5—5 of FIG. 4.
Figure 6:
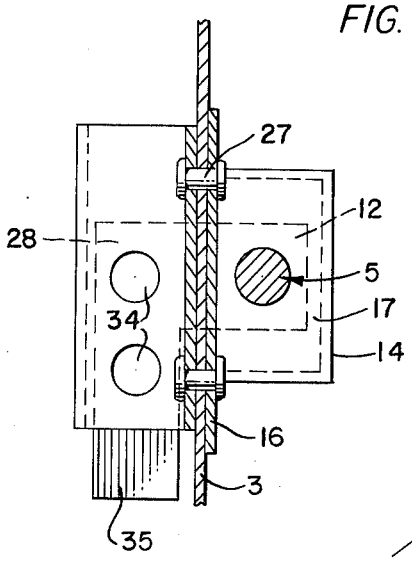
FIG. 6 is a vertical sectional view taken along the line 6—6 of FIG. 4.

Referring now to the drawings, particularly FIG. 1, the present invention will be understood to include a door, generally designated 1, associated with a door jamb or frame 2, with both structures preferably constructed of sheet metal. The door may comprise a single panel 3 having inturned peripheral edges such as the illustrated side edge 4 and the gauge of the material forming the panel and its edges is quite obviously selected to ensure sufficient rigidity and resistance against unwarranted forced deformation. With such a construction it is not necessary to include a second inner door panel when the appearance of the inside of the door is of little concern, such as when the door 1 is employed to secure the sole entrance to a storage chamber and accordingly a substantial savings in expense is achieved.

Figure 7:
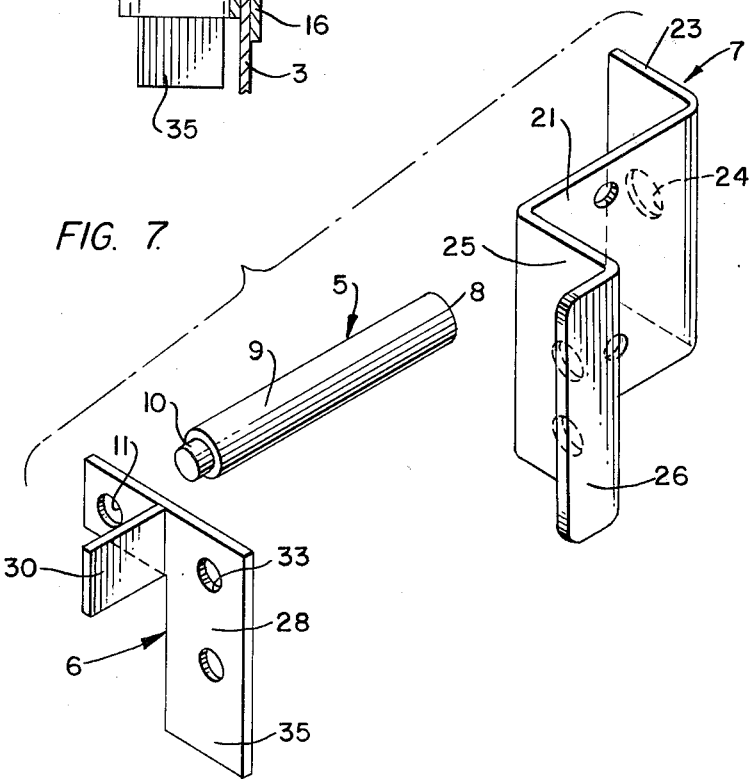
FIG. 7 is an exploded perspective view illustrating the bolt, actuator and handle member of the present invention.

The locking mechanism associated with the door 1 includes three principal components as shown in FIG. 7 of the drawings, namely, an elongated bolt 5, bolt actuator 6 and handle member 7. The bolt 5 which is preferably cylindrical in cross section, includes a nose 8 at one end and a base portion 9 at the other, with the latter including means to facilitate permanent rigid attachment to the bolt actuator 6. This attachment may be facilitated by the provision of a reduced diameter portion 10 adjacent the bolt base 9 intended to provide a close mating fit within an opening 11 formed in the inner bolt section 12 of the actuator 6, after which the bolt and actuator may be rigidly secured to one another such as by welding or the formation of the head 13 as shown most clearly in FIGS. 3 and 5 of the drawings.

The aforedescribed bolt/actuator sub-assembly is slidably supported and guided in the area adjacent its base 9 by means of a bolt guide member generally designated 14, which is secured to the inside face 15 of the door panel 3. The guide member 14 will be seen to include a front wall 16 flushly disposed against the door panel inside face 15 in the area adjacent the door side edge 4, and to which is attached a vertical wall 17 from which extends a rear wall 18 parallel to but spaced from the panel inside face 15. A hole 19 formed in the vertical bolt guide member wall 17 slidably receives the rear portion or base 9 of the bolt 5 with the inner bolt section 12 of the actuator 6 disposed intermediate the guide member rear wall 18 and panel 3, while the nose 8 of the bolt is disposed through an opening 20 formed in the door side edge 4.

The aforedescribed components are retained in the position illustrated in the various figures of the drawings by means of the handle member 7, which includes a planar front base plate 21 adapted to overlie the outside surface 22 of the door panel 3 in the area from the door side edge 4 to a point oppositely disposed the bolt guide member vertical wall 17. This handle member includes an edge plate 23 disposed normal to the base plate 21 and overlying the exposed surface of the door side edge 4 and is provided with a bolt opening 24 aligned with the opening 20 in the door side edge 4. Extending outwardly from the opposite edge of the base plate 21 is a lock plate 25 terminating in a door handle offset plate 26. The described unitary member 7 is affixed to the door 1 by suitable fastening means such as the rivets 27 which pass through not ony the base plate 21 and the door panel 3, but also at the same time are secured to the front wall 16 of the bolt guide member 14 such that all of the described components are suitably attached with respect to the door panel in a simple, most efficient manner.

The bolt actuator 6 will be seen to include a lock section 28 integral with the inner bolt section 12, but which projects forwardly therefrom through a bolt actuator cutout 29 formed in the door panel 3 immediately adjacent the area of the aligned bolt guide member vertical wall 17 and handle member lock plate 25. The actuator 6 additionally includes a planar stabilizing and security plate 30 projecting normal to one face of the actuator 6 in a direction away from the base 9 of the bolt 5 and positioned so as to slidably and directly engage the inside face 15 of the door panel 3 as shown most clearly in FIGS. 3 and 5 of the drawings. The function of the stabilizing and security plate 30 should be quite obvious when it is understood that the bolt 5 is preferably of cylindrical cross section and thus will require means to assist in maintaining the bolt actuator 6 in proper registry with respect to the cutout 29 and additionally it will be noted that when the bolt and actuator are displaced to the locked position whereupon the lock section 28 is juxtaposed the handle member lock plate 25, the otherwise open cutout 29 will be closed or masked by the stabilizing and security plate 30, thus precluding the admission of any force applying tool or device therethrough.

From a review of FIGS. 2, 3 and 5 of the drawings, it will be appreciated that in addition to serving as a handle for opening and closing the door 1, the offset plate 26 of the handle member 7 will shield the lock section 28 of the bolt actuator 6 when the bolt is in the locked position, at which point a suitable locking device such as a padlock 31 may have its shackle 32 inserted through mating opposed openings 33 and 34 provided in the bolt actuator 6 and lock plate 25 respectively. Following subsequent removal of the lock device 31 the actuator 6 may be readily displaced away from the lock plate 35 in order to slidably displace the bolt 5 from the position shown in FIG. 3 to that as shown in FIG. 5 of the drawings and to facilitate this action the lock section 28 of the bolt actuator is provided with a depending hand portion 35 which projects downwardly beneath the lower edge of the handle member 7 at least a sufficient distance to enable an operator to readily grasp the same when the remainder of the lock section 28 is disposed behind the offset plate 26.

The aforedescribed door 1 and its locking structure may be utilized in combination with any suitable door jamb or frame 2 such as shown most clearly in FIGS. 2, 3 and 5 of the drawings, wherein it will be seen that a hollow metal arrangement is provided including a side wall 40 juxtaposed the door side edge 4 and which is supported by an appropriate front wall 41 and rear wall 42. A suitable door stop 43 is associated with the frame side wall 40 and will be seen to include a stop side wall 44 joined to a stop shoulder 45, the latter serving to abut the rear of the door side edge 4 and the rear edge of the handle member edge plate 23 to both limit the inward movement of the door when displaced in the closed position and also to restrict the depth of unwarranted insertion of pry bars or other tools between the door frame 2 and door side edge 4. To further minimize the necessary nominal air space inherently required between the juxtaposed door side edge 4 and frame side wall 40, the side wall 40 is cut out as at 46 for a vertical extent only slightly exceeding the vertical height of the handle member 7 in order to admit the additional thickness of the handle member edge plate 23 when the door is closed. Accordingly, a separate keeper plate 47 is permanently affixed within the frame 2 in the area adjacent the cutout 46 and this plate is provided with a suitable bolt opening 48 to receive the nose 8 of the bolt 5 when the lock is closed as in FIGS. 2 and 3 of the drawings.

We claim:

1. A door lock assembly including, a door having a panel provided with outside and inside faces and a vertical side edge, a handle member including a front base plate affixed to said panel outside face adjacent said side edge, a bolt guide member affixed to said panel inside face behind said handle member, said door side edge and guide member having spaced apart horizontally aligned openings, an elongated linear bolt having a nose disposed through said side edge opening and a base portion extending through said guide member opening, said panel provided with a cut-out juxtaposed said bolt base portion, a bolt actuator transversely disposed through said cut-out having a bolt section inside said panel secured to said bolt base portion and a lock section disposed outside said panel, a planar stabilizing plate affixed to said actuator inside bolt section and projecting normal thereto away from said bolt base portion and in sliding overlying engagement with said panel inside face with the vertical and horizontal extent of said stabilizing plate no less than the corresponding dimensions of said underlying panel cut-out, said handle member provided with a lock plate projecting outwardly from said front base plate adjacent said panel cut-out, an offset handle plate extending from said lock plate in a direction at least partially overlying said panel cut-out, said panel cut-out extending horizontally from a point adjacent said lock plate to a point restricting displacement of said bolt nose to an area adjacent said panel side edge opening, said lock section and lock plate including horizontally aligned openings adapted to receive the shackle of a locking device whereby, said bolt is selectively displaceable to extend said nose substantially beyond said door side edge by manually displacing said actuator lock section toward said handle member lock plate and behind said handle member offset plate at which point said lock section and lock plate openings are juxtaposed.

2. A door lock assembly according to claim 1 wherein, said bolt guide member includes a vertical wall provided with said guide member opening and disposed normal to said panel and a front wall on said guide member joined to said vertical wall, overlying said panel inside face behind said handle member front base plate and extending toward said panel side edge.

3. A door lock assembly according to claim 2 including fastener means disposed through said handle member base plate, guide member front wall and intermediate door panel.

4. A door lock assembly according to claim 1 wherein, said handle member front base plate extends from said panel cut-out to said panel side edge and includes an edge plate joined to said base plate and overling said panel side edge, and said edge plate is provided with an opening juxtaposed said side edge opening.

5. A door lock assembly according to claim 4 including a door frame adjacent said panel side edge when said door is closed, said frame having a side wall parallel to and juxtaposed said panel side edge when closed, said side wall provided with a cut-out adjacent said handle member edge plate and a keeper plate mounted behind said frame cut-out and including a bolt opening aligned with said panel side edge opening when said door is closed.

* * * * *